US006207275B1

(12) United States Patent
Heffner et al.

(10) Patent No.: US 6,207,275 B1
(45) Date of Patent: Mar. 27, 2001

(54) MELT SPUN FLUOROPOLYMERIC FIBERS AND PROCESS FOR PRODUCING THEM

(75) Inventors: Glenn William Heffner, Centerville; William Cheng Uy, Hockessin; Martin Gerald Wagner, Wilmington, all of DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/477,584

(22) Filed: Jan. 4, 2000

Related U.S. Application Data

(62) Division of application No. 09/124,132, filed on Jul. 29, 1998, now Pat. No. 6,048,481, which is a continuation of application No. PCT/US98/12606, filed on Jun. 16, 1998.

(60) Provisional application No. 60/050,220, filed on Jun. 19, 1997, now abandoned.

(51) Int. Cl.[7] ..... D01F 6/00; D01F 6/12

(52) U.S. Cl. ..... 428/364; 428/394

(58) Field of Search ..... 428/394, 364

(56) References Cited

U.S. PATENT DOCUMENTS

| | | | |
|---|---|---|---|
| 3,770,771 | 11/1973 | Hartig et al. | 260/87.5 A |
| 5,460,882 | 10/1995 | Vita et al. | 428/364 |
| 5,552,219 | 9/1996 | Vita et al. | 478/357 |

FOREIGN PATENT DOCUMENTS

| | | | |
|---|---|---|---|
| 41 31 746 A1 | 3/1993 | (DE) | C08F/214/26 |
| 2-91210 | 3/1990 | (JP) | D01F/6/32 |
| 3-10723 | 2/1991 | (JP) | D01F/6/12 |

OTHER PUBLICATIONS

A.M. Kronfel'd et al., Some Aspects of Spinning Fibers From Fluorine–Containing Copolymers By Melt Extrusion, *Translated from Khimicheskie Volokna*, vol. 2, pp. 28–30, Mar.–Apr., 1986.

A.M. Kronfel'd et al., Preparation of F–50 Fluorine–Containing Fibres By Extrusion From The Melt,*Translated from Khimicheskie Volokna*, vol. 1, pp. 13–14, Jan.–Feb., 1982.

A.V. Bezprozvannykh et al., Certain Rheological Properties Of Ftoroplast–50 Melts and Their Influence On Fiber Formation, *Translated from Zhurnal Prikladnoi Khimii*, vol. 59, 952–955, Apr. 1986.

A.M. Kronfel'd et al., Rheological Characteristics and Melt Flow Properties of Fiber–Forming Fluoroplastic F–50, Nov. Reol. Polim., Mater.Vses.Simp.Reol. 11$^{th}$ 1982 1, No: 266–9 (1980).

T.S. Dorutina et al., Rheological and Fiber–Forming Properties of Ftoroplast [Fluoroplastic] 4MB, Khim. Prom St., Ser.: Prom St. Khim. Volokon 6, No.: 8–11 (1979).

*Primary Examiner*—Newton Edwards

(57) ABSTRACT

This invention pertains to melt spun fibers of copolymers formed from tetra-fluoro ethylene and perfluorovinyl monomers and a process for their formation. In the process of this invention fibers exhibiting high strength and low shrinkage are drawn from the melt at SSFs of at least 500×.

20 Claims, 3 Drawing Sheets

MELT SPUN FLUOROPOLYMERIC FIBERS AND PROCESS FOR PRODUCING THEM

CROSS-REFERENCE TO RELATED APPLICATIONS

This application is a divisional of U.S. patent application Ser. No. 09/124,132, filed Jul. 29, 1998, now U.S. Pat. No. 6,048,481, which is a continuation of International Application No. PCT/US98/12606, filed Jun. 16, 1998 which claims priority benefit of Provisional Application Serial No. 60/050,220, filed Jun. 19, 1997, now abandoned.

FIELD OF THE INVENTION

This invention relates to melt spun fibers of copolymers formed from tetra-fluoroethylene and perfluorovinyl monomers. In the process of this invention fibers exhibiting high strength and low shrinkage are drawn from the melt at spin stretch factors of at least 500×.

TECHNICAL BACKGROUND OF THE INVENTION

Hartig et al. (U.S. Pat. No. 3,770,711) disclose fibers made from copolymers of tetrafluoroethylene (TFE) and 1–7% by weight perfluoropropyl vinyl ether (PPVE). Methyl, ethyl, butyl, and amyl vinyl ether comonomers are also disclosed. Fiber is melt spun with little or no draw-down, followed by a drawing step performed below the melting point. Fibers so fabricated are ca. 500 $\mu$m in diameter, exhibiting thermal shrinkage of 15% at 250° C.

Vita et al. (U.S. Pat. No. 5,552,219) disclose multifilament yarns comprising fibers made in a two step process from copolymers of TFE with 2–20 mol % of perfluoroolefins having 3 to 8 carbon atoms, or with 1–5 mol % of perfluorovinylalkyl ethers, the copolymers having a melt flow index of 6–18 g/10 min according to ASTM D3307. In the first step, a fiber is melt spun with a spin stretch factor in the range of 50 to250, with 50 to 150 preferred; spin stretch factor of 75 spun at 12–18 m/min is exemplified. In the second step, the spun fiber is post-drawn at 200° C. to produce the final product. The as-spun fiber exhibits tenacity of 50 to 80 MPa at 23° C. and less than 10% shrinkage at 200° C. In the second step, the as-spun fiber is drawn at a temperature below the melting point to provide a fiber with tensile strength of 140–220 MPa. Fiber diameters of 10 to 150 micrometer diameter (1.7 to $380\times10^{-7}$ kg/m) are disclosed.

In the process of Umezawa (JP 63-245259), a first step involves forming a mixture of a melt-processible fluorinated resin with a melt-processible hydrocarbon resin wherein the fluorinated resin occupies less than 50% of the volume of the mixture, and forms therein a discontinuous phase dispersed within a continuous hydrocarbon phase. In a second step, a fiber is melt spun from the mixture without draw-down, and in a third step the fiber so formed is drawn below the melting temperature of the fluorinated resin. In a fourth step, the hydrocarbon moiety is dissolved, leaving a very fine linear density fluoropolymer fiber. A TFE/HFP fiber with linear density of $2.2\times10^{-9}$ kg/m, and tenacity of ca. 400 MPa is exemplified. Disclosed without exemplifications is a ca. $3.5\times10^{-8}$ kg/m fiber of TFE/perfluoroalkoxyethylene with tenacity of 190 MPa.

Nishiyama et. al (JP 63-219616) disclose a process for spinning and drawing fibers from Teflon® PFA 340-J (Mitsui-DuPont) which retain the cross-sectional shape of the spinneret hole. $110\times10^{-7}$ kg/m (ca. 80 $\mu$m) fiber with 190 MPa tenacity and 17% ultimate elongation is produced by melt spinning without draw-down at 10 m/min, followed by post-drawing 5×.

Bonigk (P41-31-746 A1—Germany) disclosed fiber made from ethylene/tetrafluoroethylene/perfluoropropyl vinyl ether (E/TFE/PVVE) co-polymers wherein the TFE moiety does not exceed 60 mol %. Spinning speed in excess of 800 m/min are disclosed, but spin stretch factor is limited to ca. 100:1. The fibers are characterized by using a thermoplastic copolymer having a melt index of at least 50 g/10 min. (DIN Standard 53 735).

Kronfel'd et al. (Khimicheskie Volokna, No. 1, pp 13–14, 1982) disclose fibers 30–60 micrometer in diameter made by melt spinning a TFE/perfluoroalkyvinyl ether copolymer at a jet stretch of 3500% (corresponding to a spin stretch factor, SSF, of 36) followed by a hot stretch at a ratio of 2.2×. The fiber so produced exhibiited a tenacity of 14.6 cN/tex (corresponding to ca. 315 MPa), a shrinkage in boiling water of 12–15%, and a birefringence of 0.050.

Kronfel'd et al. (Khimicheskie Volokna, No. 2, pp 28–30, 1986) disclose fibers 18 micrometers in diameter and larger of a TFE/perfluoroalkylvinyl ether copolymer containing 3–5 mol % of the vinyl ether. Disclosed is a maximum obtainable spin draw ratio of 850× at 400° C. spinning temperature, for polymer of MFR 7.8–18, yielding fiber of maximum tensile strength of 180 MPa.

According to the teachings of the art, which are limited to spin stretch factors of 850× or less, usually less than 500×, low linear density fibers (particularly those of less than $11\times10^{-7}$ kg/m) can be prepared only by extruding through a narrow extrusion die at low throughputs, at a large economic penalty. Higher extrusion speed, more consistent with low-cost commercial production rates, results in melt fracture and fiber breakage. And, to achieve tensile strengths of greater than ca. 190 MPa requires the additional cost and complexity of a second stage draw on the spun fiber.

Thus, the practices of the known art present several problems to the practitioner thereof. A first problem has to do with producing fiber of linear density below ca. $100\times10^{-7}$ kg/m, especially less than ca. $40\times10^{-7}$ kg/m, at commercially practical rates. A second problem has to do with producing fiber with tensile strength of greater than ca. 190 MPa. A third problem has to do with providing for a lower cost process over the slow-speed spinning and multi-step processes of the known art. The fibers produced by the known art also exhibit undesirably high shrinkage of at least 15% at 250° C., limiting their usefulness. Many of the disadvantages of the art are overcome by the process of the present invention wherein the spin stretch factor of the present invention is at least 500. Using the process of the present invention, high strength, low shrinkage low-linear density fibers comprising perfluorinated thermoplastic copolymers of TFE of a wide range of melt flow ratios can be produced at very high spinning speeds in a single step operation, thus increasing productivity and decreasing production costs.

SUMMARY OF THE INVENTION

The present invention provides for a fluoropolymer fiber comprising a perfluorinated thermoplastic copolymer of tetrafluoroethylene (TFE) having a melt flow rate (MFR) of about 1 to about 30 g/10 min., the fiber exhibiting a tensile strength of at least 190 MPa and a linear shrinkage of less than 15% at a temperature in the range of 40–60 centigrade degrees below the melting point of the copolymer. The copolymers herein are copolymers of TFE and at least one comonomer selected from the group consisting of perfluoro-olefins having at least three carbon atoms, perfluoro(alkyl vinyl) ethers, and mixtures thereof.

Further provided for is process for producing a fluoropolymer fiber. The process comprises melting and extruding a perfluorinated thermoplastic copolymer of TFE and a comonomer selected from the group consisting of perfluoro-olefins having at least three carbon atoms, perfluoro(alkyl vinyl)ethers, and mixtures thereof, having a MFR of about 1 to about 30 g/10 min., through an aperture, to form one or more strands, directing the thus extruded strand or strands through a quench zone while accelerating the linear rate of progression of the strand or strands to at least 1000 times greater than the linear rate of extrusion thereof, allowing the extrudate to solidify in transit between the extrusion aperture and a means for imposing said acceleration.

Still further provided for is a process for producing a fluoropolymer fiber the process comprising melting and extruding a perfluorinated thermoplastic copolymer of TFE and a comonomer selected from the group consisting of perfluoro-olefins having at least three carbon atoms, perfluoro(alkyl vinyl) ethers, and mixtures thereof, having a MFR of about 1 to about 6 g/10 min., through an aperture, to form one or more strands, directing the thus extruded strand or strands through a quench zone while accelerating the linear rate of progression of the strand or strands to at least 500 times greater than the linear rate of extrusion thereof, allowing the extrudate to solidify in transit between the extrusion aperture and a means for imposing said acceleration.

The present invention also provides a fluoropolymer fiber exhibiting a tensile strength of at least 190 MPa and a linear shrinkage of less than 15% at a temperature in the range of 40–60 centigrade degrees below the melting point of the copolymer produced by the process comprising melting and extruding a perfluorinated thermoplastic copolymer of TFE and a comonomer selected from the group consisting of perfluoro-olefins having at least three carbon atoms, perfluoro(alkyl vinyl) ethers, and mixtures thereof, having a melt flow rate of about 1 to about 30 g/10 min., through an aperture to form one or more strands, directing the thus extruded strand or strands through a quench zone, accelerating the linear rate of progression of the strand or strands to at least 1000 times greater than the linear rate of extrusion thereof, and allowing the extrudate to solidify in transit between the extrusion aperture and a means for imposing said acceleration.

The present invention further provides a fluoropolymer fiber exhibiting a tensile strength of at least 190 MPa and a linear shrinkage of less than 15% at a temperature in the range of 40–60 centigrade degrees below the melting point of the copolymer produced by the process comprising melting and extruding a perfluorinated thermoplastic copolymer of tetrafluoroethylene and a comonomer selected from the group consisting of perfluoro-olefins having at least three carbon atoms, perfluoro(alkyl vinyl) ethers, and mixtures thereof, having a melt flow rate of ca. 1–6 g/10 min., through an aperture, to form one or more strands, directing the thus extruded strand or strands through a quench zone while accelerating the linear rate of progression of the strand or strands to at least 500 times greater than the linear rate of extrusion thereof, allowing the extrudate to solidify in transit between the extrusion aperture and a means for imposing said acceleration.

DETAILED DESCRIPTION OF THE INVENTION

This invention provides for a novel fluoropolymeric fiber with high tensile strength and low shrinkage. The product of this invention may be in the form of a monofilament or a multi-filament yarn.

Fluoropolymers suitable for use in the present invention are melt processible perfluorinated copolymers of TFE, many of which are known in the art, and of which several are in widespread commercial use. Comonomers with TFE are selected from the group consisting of perfluoro-olefins having at least three carbon atoms, such as perfluorovinyl alkyl compounds; perfluoro(alkyl vinyl) ethers; and mixtures thereof. Preferred are copolymers of TFE with about 1 to about 20 mol % of a perfluorovinyl alkyl comonomer, more preferably about 3 to about 10 mol % of the perfluorovinyl alkyl comonomer. Hexafluoropropylene is a preferred perfluorovinyl alkyl comonomer and hexafluoropropylene at about 3 to about 10 mol % is most preferred. Copolymers of TFE with about 0.5 to about 10 mol % of a perfluoro(alkyl vinyl) ether are preferred, and perfluoro(alkyl vinyl) ethers of about 0.5 to about 3 mol % are more preferred. PPVE or perfluoroethyl vinyl ether (PEVE) are preferred perfluoro (alkyl vinyl) ethers for the practice of this invention, and PPVE or PEVE at about 0.5 to about 3 mole % are most preferred. The term "copolymer", for the purposes of this invention, is intended to encompass polymers comprising two or more comonomers is a single polymer. Thus, also suitable for the practice of this invention are mixtures of comonomers hereinabove cited as suitable for the practice of this invention. The terms perfluoropropylvinyl ether and perfluoroethylvinyl ether will be represented as "PPVE" and "PEVE", respectively.

The polymers suitable for the practice of this invention exhibit a melt flow rate (MFR) of about 1 to about 30 g/10 minutes as determined at 372° C. according to ASTM D2116, D3307, preferably the MFR is about 1 to about 6 g/10 minutes.

The fibers of this invention are unusual in their combination of high strength and low shrinkage. The fibers of this invention are characterized by room temperature tensile strengths of at least 190 MPa, as determined by ASTM D3822 and shrinkage of less than 15% as determined at a temperature 40° C.–60° C., below the melting point of the copolymer according to ASTM D5104.

Figure 3:
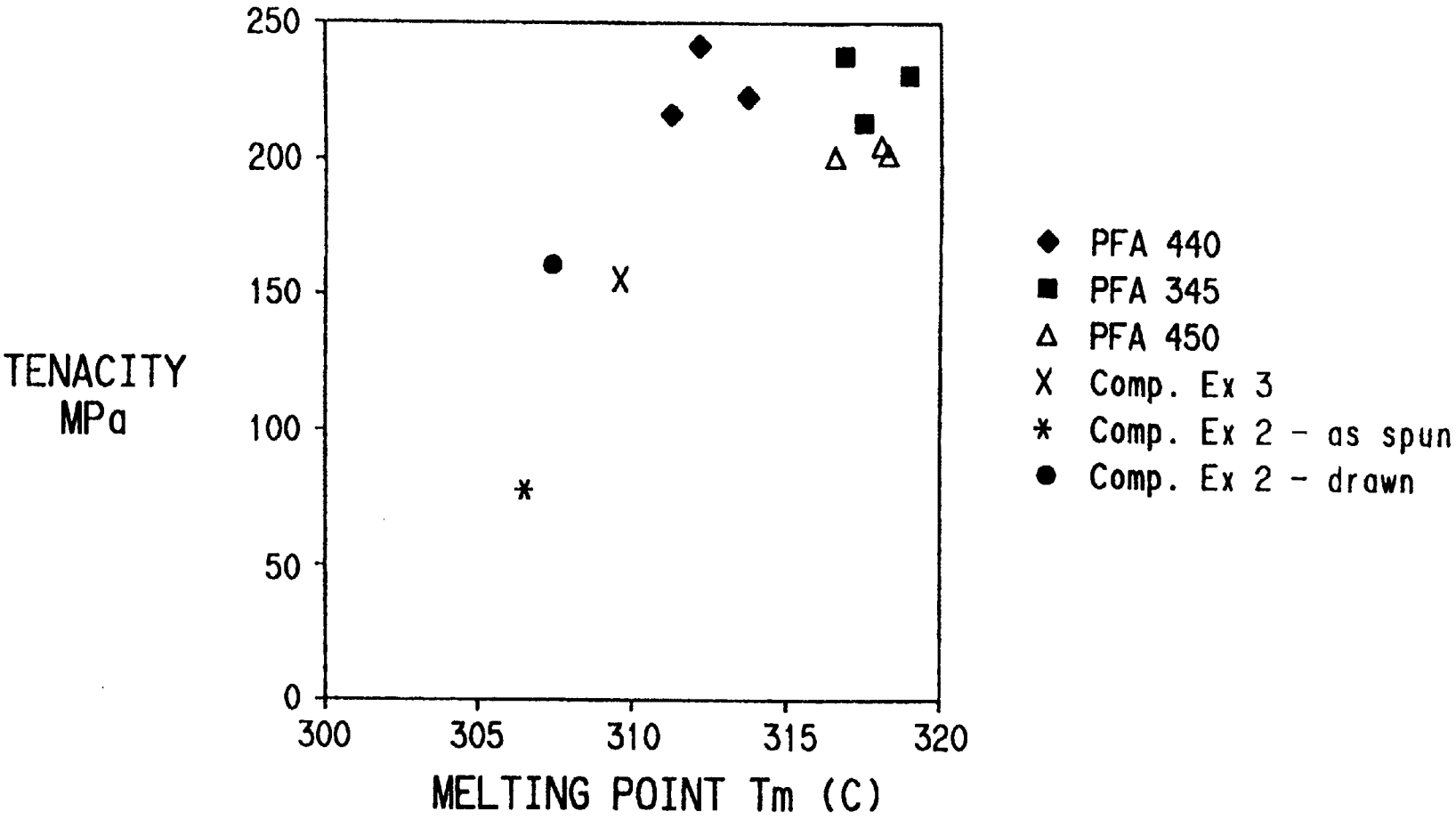
FIG. 3 is a graphical representation of tenacity versus melting point for single filament fibers of the present invention and single filament fibers produced in Comparative Examples 2 and 3.

The fibers of the present invention can be further characterized by the presence of a melting point above 310° C. as determined by Differential Scanning Calorimetry (DSC). This is depicted in FIG. 3 along with the tensile strength of a series of fibers spun according to the methods taught herein and compared with fibers of Comparative Examples 2 and 3. A higher temperature melting point seems to be correlated with tensile strength. It is to be noted that the data points in FIG. 3 above 190 MPa are also above 310° C. melting point and are the fibers of the present invention. In addition to a melting point above 310° C., the fibers of the present invention can be further characterized by a birefringence greater than about 0.037.

In one embodiment, fibers of the present invention are characterized by room temperature tensile strength of at least 190 MPa, a linear density of about $1\times10^{-7}$ to about $250\times10^{-7}$ kg/m, preferably about $1\times10^{-7}$ to about $12\times10^{-7}$ kg/m, and a shrinkage of less than 10% as determined at a temperature 40° C.–60° C. below the melting point of the polymer according to ASTM D5104.

In the process of the present invention, the molten copolymer suitable for the practice of the invention is extruded through an aperture to form a continuous strand or strands which are directed through a quench zone to a means for accumulating the spun fiber, the extruded strand being subject to drawing between the aperture and the accumulation means. For the purposes of this invention, the ratio of the linear rate of fiber accumulation to the linear rate of extrusion is called the spin stretch factor (SSF). In the process of this invention, the SSF is at least 500, with at least 1000 preferred. As used herein and as understood by one of ordinary skill in the art, the linear rate of fiber accumulation, the linear rate of progression, spinning speed, wind up speed, and take up speed are synonymous.

Figure 1:
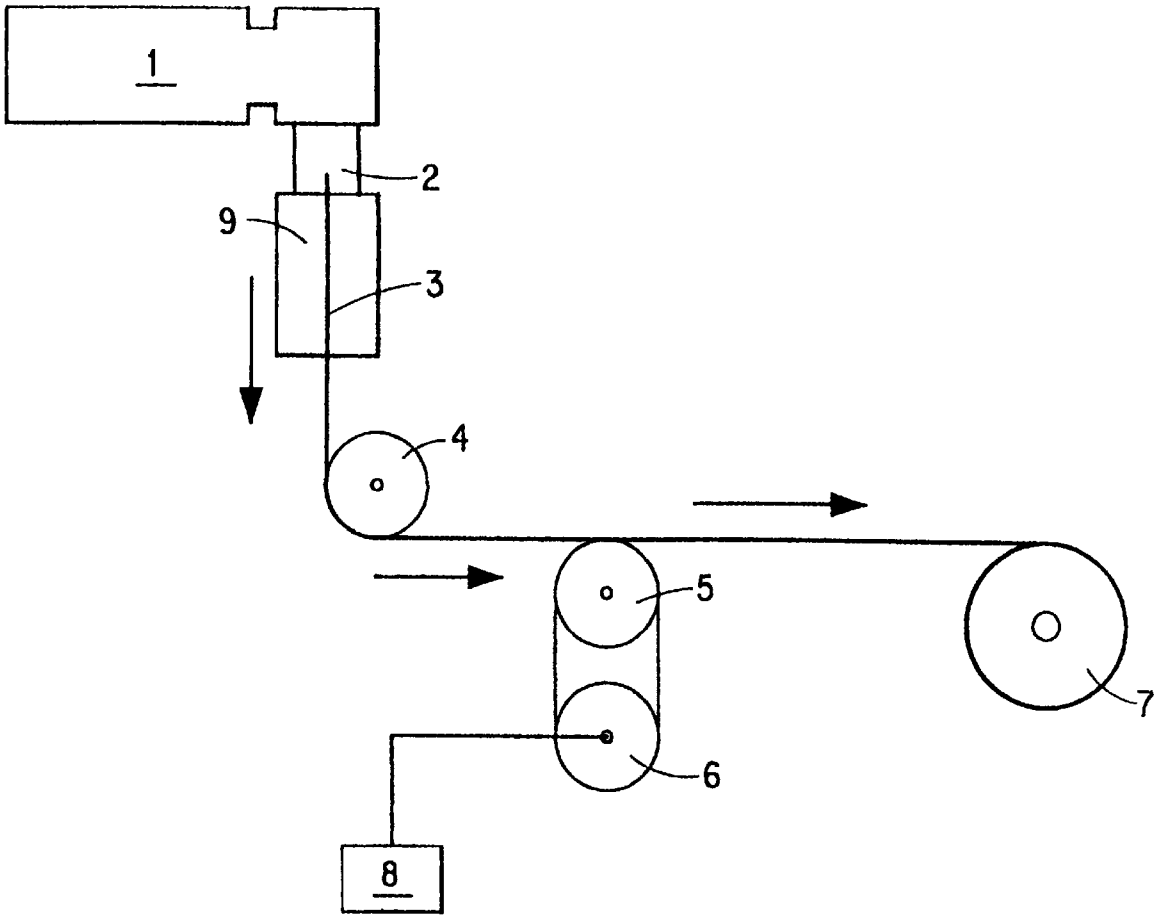
FIG. 1 shows an apparatus suitable for use in the preferred embodiment of the process of the present invention.

Any means known in the art for preparing a fiber from the melt is suitable for application to the process of this invention. In a preferred embodiment of the process of this invention, a screw extruder is employed to feed a polymer suitable for the practice of the invention in melt form to a single or multi-aperture strand die to form, respectively, a monofilament or multifilament fiber product. In FIG. 1 a single-screw extruder, 1, supplies the perfluorinated resin suitable for the practice of this invention to a single-aperture strand die, 2, the die being configured so that the strand is extruded in a vertically downward direction. Extrudate strand, 3, is directed through a quench zone 9, to a guide wheel, 4, and thence to a pair of take-off rolls, 5 and 6, at least one of which is driven by a high speed motor drive controlled by a high speed controller 8 and from the take-off rolls to a high-speed tension controlled wind-up, 7. The wheel 4 and rolls 5 and 6 are mounted on low friction bearings. The extruder barrel and screw, and the die are preferably made from high nickel content corrosion resistant steel alloy. Many suitable extruders, including screw-type and piston-type, are known in the art and available commercially.

In the process of the invention, a copolymer suitable for the practice of this invention is melted and fed to the extrusion aperture by any means known in the art, with particular attention paid to avoiding degradation of the polymer. It has been found satisfactory in the practice of this invention to charge a heated cylinder with the polymer wherein the polymer is first melted and then ram fed to an extrusion die using a screw-driven ram.

The rates of extrusion suitable for the process of the invention depend upon the size of the operating window defined by the upper critical shear rate for the onset of melt fracture and the lower critical shear rate for the onset of draw resonance. The upper critical shear rate for the onset of melt fracture is in turn determined by the temperature, polymer melt flow rate, and die dimensions. "Melt fracture" is a flow instability which produces an irregular surface on the fiber. "Draw resonance" is a cross-sectional variation along the length of the drawn fiber. Draw resonance is influenced by the temperature of the quench zone, in addition to the above-mentioned parameters. When employing the polymers preferred for the practice of this invention, it was found that satisfactory results with any given polymer were obtained over a range of shear rates which was relatively narrow, and depended upon the particular polymer in process. Since the critical shear rate for onset of melt fracture varies inversely with melt viscosity, the operating window grows progressively narrower as MFR decreases. The operating window can be expanded by increasing the temperature, but care must be taken to avoid polymer degradation.

The extrusion aperture need not be of any particular type. The shape of the aperture may be of any desired cross-section, with circular cross-section preferred. It is found in the practice of this invention that the cross-section of the resultant fiber closely mimics the shape of that of the aperture through which the polymer has been extruded. The diameter of a circular cross-sectional aperture found suitable for use in the process of this invention is in the range of about 0.5 to about 4.0 mm, but the practice of this invention is not limited to that range. The length to diameter ratio of the die aperture is preferably in the range of about 1:1 to about 8:1. Strand dies and spinnerets of conventional design, well-known in the art, both single filament and multifilament, are suitable for the practice of this invention.

In the process of the present invention, the extrudate in the form of one or more strands passes through a quench zone to a means for accumulating the spun fiber. The extrudate is allowed to solidify in transit between the aperture and the means for accumulating the spun fiber or means for imposing acceleration of the linear rate of progression. Such means are known to those of ordinary skill in the art. The quench zone may be at ambient temperature, or heated or cooled with respect thereto, depending upon the requirements of the particular process configuration employed. Lowest shrinkage is achieved when the quench zone is at or below ambient air temperature.

It has been found in the practice of the invention that fibers in the range of linear density from ca. $1\times10^{-7}$ to ca. $5\times10^{-7}$ kg/m prepared from polymer of MFR less than ca. 20 are preferably obtained by passing the extrudate through a heated tube contiguous with and just down-stream from the extrusion aperture, the heated tube being maintained at a temperature in the range of the melting point of the polymer to 100° C. below the melting point thereof. In general, for a given copolymer and given extrusion conditions, higher SSFs are achievable the higher the temperature of the quench zone and the longer the residence time in the quench zone, thereby enabling the attainment of fibers of progressively lower linear densities. Spinning of multistrand fiber yarns may require that the quench zone be maintained at a lower temperature than that required to produce a single fiber or monofilament.

Heating may be accomplished by use of a heated tube, impingement of hot air, or radiative heating. Cooling may be accomplished by use of a refrigerated tube, impingement of refrigerated or room temperature air, or radiative cooling.

In the practice of the present invention a trade-off exists between the higher SSFs, and thus lower linear density fibers, achievable by employing a heated quench zone and the shrinkage of the fiber so produced. Thus, for example, in a preferred embodiment of the present invention, fibers of ca. $1–5\times10^{-7}$ kg/m are advantageously spun from polymer of MFR <ca. 20 by directing the extrudate through a heated quench zone. Shrinkage of these fibers at 250° C. is typically in the range of 5–15%. Fibers of linear density $>5\times10^{-7}$ kg/m spun into ambient air exhibit thermal shrinkage of 6% or less.

Any means for accumulating the drawn fiber or accelerating the linear rate of progression is suitable for the practice of the invention. Such means include a rotating drum, a piddler, or a wind-up, preferably with a traverse, all of which are known in the art. Other means include a process of chopping or cutting the continuous spun-drawn fiber for the purpose of producing a stable fiber tow or a fibrid. Still other means include a direct on-line incorporation of the spun-drawn fiber into a fabric structure or a composite structure. One means found suitable in the embodiments hereinbelow described is a high-speed textile type wind-up, of the sort commercially available from Leesona Co. (Burlington, N.C.).

For practical reasons, the highest possible take-up speed consistent within the goal fiber properties is desirable. The maximum achievable take-up speed depends upon the melt flow rate of the polymer and operating temperature for any given spinning configuration. For the practice of this invention, it has been found that take-up speed of 30 m/min is satisfactory. However, a linear rate of progression above 200 m/min and as high as 625 m/min have been achieved. No upper limit to the spinning speed has been determined. A linear rate of progression of the strand of at least 200 m/min is preferred.

Such other means as are known in the art of fiber spinning to assist in conveying the fiber may be employed as warranted. These means include the use of guide pulleys, polished take-off rolls, air bars, separators and the like.

Spin stretch (drawing of the molten fiber) is accomplished by any convenient means. In one embodiment of the present invention, the spun fiber is conveyed to a set of polished metal take-off rolls which are operated to convey the fiber at a linear rate of progression 500 times, preferably 1000 times, greater than the linear rate of extrusion thereof. In another embodiment of the present invention, the spun fiber is directed to a nip formed by two rolls set a fixed distance apart and caused to rotate at a linear rate of progression 500 times, preferably 1000 times, greater than the linear rate of extrusion thereof. In yet another embodiment, the fiber is conveyed directly to a high speed windup operating at a linear rate 500 times, preferably 1000 times, greater than the linear rate of extrusion thereof.

The maximum achievable SSF is a function of polymer melt viscosity, which is, in turn, a function of temperature and polymer MFR. Obtaining a SSF of greater than 1000 can be problematic when using low temperatures and/or low MFR materials due to fiber breakage during spinning. However, under such conditions it has been found that SSFs less than 1000 are sufficient to obtain high strength and low shrinkage.

In a particularly surprising aspect of the process of the invention, it is found that the melting point of the fiber depends upon a spin factor, $F_S$, defined according to the formula.

$$F_S = \text{shear rate} \times (\text{SSF})^2$$

where the shear rate is the actual shear rate to which the molten polymer is subject in the extrusion aperture, and SSF is the actual SSF employed.

Spinning fibers of MFR of about 1 to about 6 g/10 min. can present a particular problem, since it may be difficult to achieve a SSF of greater than 1000 at a temperature below the onset of thermal degradation (ca. 400° C. for the most preferred polymers). However, it is found, surprisingly, in the practice of this invention that the desirable features of low linear density, high strength, and low shrinkage can be achieved with polymer of MFR of about 1 to about 6 g/10 min. by employing SSFs in the preferred range of about 500 to about 1000.

While no particular lower limit to the combination of MFR and linear density of the spun fiber have been determined for the practice of this invention, it is believed that for polymer of MFR of about 1 to about 6, the lowest linear density, d, available by the process of this invention is limited approximately by the equation:

$$d = [12 - (2 \times \text{MFR})] \times 10^{-7}.$$

The high SSFs and high spinning speeds associated with the process of the present invention make it particularly susceptible to upset as a result of contamination, variations in polymer melt properties, and variations in temperature or spinning speed. These factors combined with the low linear densities of the fibers being produced result in high susceptibility to breakage. To achieve stable spinning over long periods of time, it is desirable to employ a homogeneous resin, maintain low residence times at high temperature in corrosion resistant equipment to avoid decomposition, subject the resin to filtration prior to spinning, and employ high precision controllers for screw speed, temperature and spinning speed. It has also been found in the practice of this invention that drying the polymer prior to processing may improve spinning performance.

It should be noted that when handling fluorinated materials at elevated temperatures it is well advised to employ corrosion resistant high-nickel alloys in the metallic parts contacting the polymer.

EXAMPLES

Figure 2:
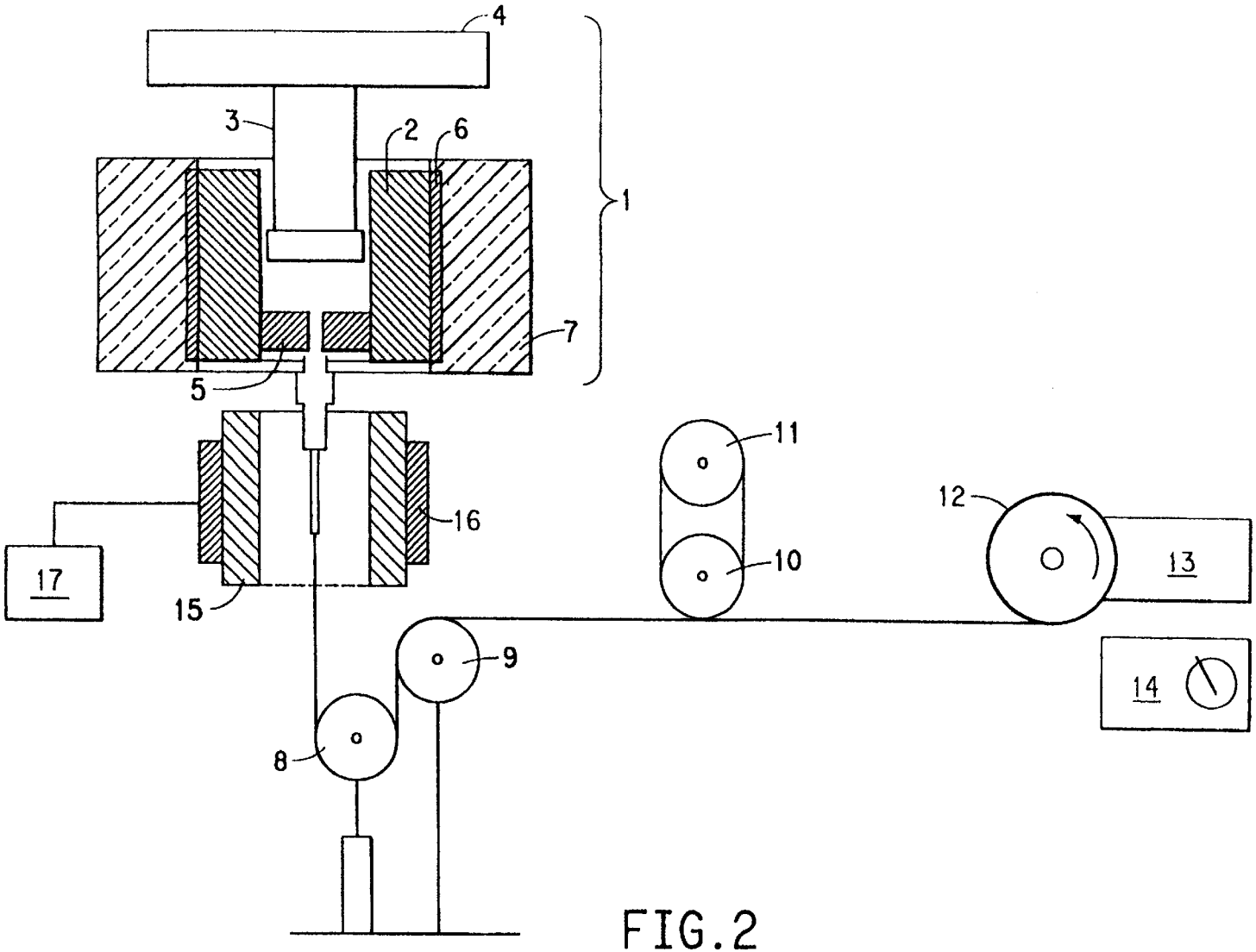
FIG. 2 shows the apparatus employed in producing the specific embodiments of the invention hereinbelow described.

The fiber spinning apparatus employed in the specific embodiments hereinbelow described is shown in FIG. 2. A capillary rheometer, 1, comprising a heated barrel 2, piston 3, and a die 5, was employed for extruding the melted polymer. The heated cylindrical steel barrel was ca. 10 cm long and ca. 7.5 cm in diameter. A cylindrical corrosion-resistant barrel insert ca. 0.6 cm thick made of Stellite (Cabot Corp., Kokomo, Ind.) provided an inner bore diameter of 0.976 cm. The barrel was surrounded by a 6.4 cm layer of ceramic insulation, 7.

An 800-W cylindrical heater band 10 cm long and ca. 7.5 cm in diameter, 6, manufactured by (I.H. Co., NY, N.Y.), controlled by an ECS model 6414 Temperature controller manufactured by (ECS Engineering, Inc. Evansville, Ind.), maintained the barrel temperature within 1° C. of set point. The piston, made of hardened steel (Armco 17-4 RH) was 0.970 cm dia. at its tip, was mounted on the screw driven crosshead, 4, of a model TT-C Instron test frame manufactured by Instru-melt, Inc., Union, N.J.

Capillary dies of circular cross-section were constructed by Hastelloy (Cabot Corp., Kokoma, Ind.). Capillary diameters ranged from0.5 to 4.0 mm, with length/diameter ratios of 1 to 8.

In operation, the fiber was extruded vertically downward to a 3.0 cm diameter nylon guide wheel 8 located 30 cm below the die, by which point the fiber had solidified. Guide wheel 8 was mounted on a force transducer (Scaime model GM2, sold by Burco, Centerville, Ohio) used to measure the spin tension. The fiber was wrapped 180° around guide wheel 8 and directed to a second guide wheel 9 (4.8 cm dia.) and from there to a pair of take-up rolls 10 and 11. The fiber was wound once around the take-up rolls, and taken up by a wind-up roll 12. Rolls 10, 11 and 12 were 5 cm in diameter, they were made of aluminum and covered with masking tape for better grip. Roll 11 was free-spinning (on ball-bearings) while rolls 10 and 12 were driven in tandem by a motor 13 having a maximum speed of 3600 rpm. The maximum take-up speed was thus ca. 600 m/min. The motor speed was controlled with a variable transformer 14. In practice the fiber was strung through the apparatus at low speed (ca. 10 m/min), then the speed was increased gradually to the desired take-up rate.

The fiber of Example 7 was prepared by adding a heated tube 15 (aluminum, 5 cm dia., 10 cm length) directly onto the die. The tube temperature was maintained at 305° C. by use of a band heater 16 attached to the exterior surface of the tube, controlled by an ECS temperature controller, 17.

All of the resin employed in the following specific embodiments was available from DuPont Company, Wilmington, Del., under the trade name "Teflon®".

EXAMPLES 1–6

Single filaments of the Teflon® PFA resins (melting point ca. 307° C.) listed in Table 1 were spun into ambient air under the conditions therein indicated. The properties of the resultant fibers thus spun are shown in Table 2.

to 305° C. was placed immediately below the die so that the fiber passed through its center. The piston rate was 0.51 mm/min and the take-up speed was 410 m/min, resulting in a SSF of 2900. Linear density was $1.7\times10^{-7}$ kg/m, tenacity was 280 MPa, initial modulus was 2100 MPa, maximum elongation was 23%. Shrinkage was 7% at 250° C.

EXAMPLES 8 AND 9

Teflon® FEP 100 (melting point ca. 258° C.) as described in Table 3 was spun under the conditions therein indicated. Properties of the spun-drawn fibers thus produced are shown in Table 4. Note that the temperature at which shrinkage was determined was 200° C. rather than the 250° C. temperature used for testing the PFA fibers.

TABLE 1

| | | Spin Conditions* | | | | | | |
|---|---|---|---|---|---|---|---|---|
| Example | Polymer Grade | MFR [g/10³] | Temp. [° C.] | Die diam. [mm] | Die length [mm] | Shear rate [/s] | Draw speed [m/min] | SSF |
| 1 | PFA 440 | 13 | 390 | 1.21 | 4.70 | 18 | 300 | 1830 |
| 2 | PFA 440 | 13 | 390 | 1.21 | 4.70 | 37 | 550 | 1650 |
| 3 | PFA 440 | 13 | 390 | 0.76 | 3.18 | 73 | 460 | 1100 |
| 4 | PFA 345 | 5.2 | 390 | 3.18 | 12.70 | 2.0 | 140 | 2900 |
| 5 | PFA 345 | 5.2 | 390 | 3.18 | 12.70 | 2.0 | 170 | 3500 |
| 6 | PFA 450 | 2 | 410 | 3.18 | 12.70 | 3.0 | 60 | 850 |

*some figures herein have been rounded

TABLE 2

| | Properties of Spun-Drawn Fibers | | | | | |
|---|---|---|---|---|---|---|
| Example | Linear Density [kg/m × 10⁷] | Tenacity [MPa] | Init. Modulus [MPa] | Max. Elongation % | Shrinkage % | Shrinkage [Temp. ° C.] |
| 1 | 9.8 | 210 | 2000 | 42 | 5 | @ 250° C. |
| 2 | 11 | 220 | 2500 | 27 | 5 | @ 250° C. |
| 3 | 6.0 | 240 | 2400 | 29 | 6 | @ 250° C. |
| 4 | 36 | 230 | 2700 | 19 | 4 | @ 250° C. |
| 5 | 29 | 280 | 3400 | 17 | 5 | @ 250° C. |
| 6 | 127 | 200 | 1200 | 37 | 4 | @ 250° C. |

EXAMPLE 7

Teflon® PFA 440 (MFR 13 g/10 min) was spun at 390° C. through a circular aperture measuring 0.61 mm diameter by 0.66 mm long. A tube (5 cm diameter, 10 cm long) heated

TABLE 3

| | | Spinning Conditions | | | | | | |
|---|---|---|---|---|---|---|---|---|
| Example | Polymer grade | MFR [g/10³] | Temp. [° C.] | Die diam. [mm] | Die length [mm] | Shear rate [/s] | Draw speed [m/min] | SSF |
| 8 | FEP 100 | 6.9 | 380 | 1.59 | 6.35 | 8 | 120 | 1270 |
| 9 | FEP 100 | 6.9 | 380 | 1.59 | 6.35 | 16 | 180 | 950 |

TABLE 4

| Ex- ample | Linear Density [kg/m × $10^7$] | Tenacity [MPa] | Init. Modulus [MPa] | Max. Elongation % | Shrinkage % | Shrinkage [Temp. ° C.] |
|---|---|---|---|---|---|---|
| | Properties of Spun-Drawn Fiber | | | | | |
| 8 | 26 | 190 | 1400 | 23 | 11 | @ 200° C. |
| 9 | 31 | 190 | 1400 | 27 | 9 | @ 200° C. |

FIG. 3 is a graphical representations of melting point versus tenacity of single filament fibers of the present invention and single filament fibers produced in Comparative Examples 2 and 3 below. Table 5 lists the spin conditions and data points used in FIG. 3.

mm long at a shear rate of 128 $s^{-1}$ (piston rate of 1.27 mm/min) and a take-up speed of 35 m/min to obtain the desired SSF of 75. The tenacity of the as-spun fiber was measured to be 76 MPa (see FIG. 3, Comp. Ex. 2-as spun), in comparison with 55 MPa reported by Vita. Initial modulus was 320 MPa, maximum elongation was 303%. Shrinkage at 250° C. was 1.6%.

The as-spun fiber was further drawn 2.2× at 200° C. on an Instron 1125 test frame (Instron Corp., Canton, Mass.) equipped with an oven (model VE3.5-600, United Calibration Corp., Huntington Beach, Calif.). A 10 cm initial length was stretched to 22 cm at a rate of 10 cm/min. The drawn sample was held in the grips while the oven was cooled to 50° C., then released. The tenacity was measured to be 155 MPa (see FIG. 3, Comp. Ex. 2-drawn), in comparison with 180 MPa reported by Vita. The initial modulus was 730 MPa, the maximum elongation was 79%. Shrinkage was 27% at 250° C.

TABLE 5

| Sample # | Ex. # | Polymer Grade | MFR [g/$10^3$] | Temp. [° C.] | Die diam. [mm] | Die length [mm] | Shear rate [/s] | Draw speed [m/min] | SSF | Tenacity [MPa] | Peak Mp [° C.] | Birefringence × 100 |
|---|---|---|---|---|---|---|---|---|---|---|---|---|
| | | | | | | Spin Conditions | | | | | | |
| A14 | 3 | PFA 440 | 13 | 390 | 0.76 | 3.18 | 73.0 | 457 | 1096 | 238 | 312.2 | 3.7 |
| A22 | 1 | PFA 440 | 13 | 390 | 1.21 | 4.70 | 18.4 | 305 | 1832 | 214 | 311.8 | 3.8 |
| A25 | 2 | PFA 440 | 13 | 390 | 1.21 | 4.70 | 36.8 | 549 | 1649 | 222 | 313.5 | 4 |
| | | | | | | | | | | | | NA |
| X | 4 | PFA 345 | 5.2 | 390 | 3.18 | 12.70 | 2.0 | 122 | 2538 | 210 | 317.3 | NA |
| Y | | PFA 345 | 5.2 | 390 | 3.18 | 12.70 | 2.0 | 137 | 2855 | 233 | 316.9 | NA |
| Z | | PFA 345 | 5.2 | 390 | 3.18 | 12.70 | 2.0 | 152 | 3172 | 227 | 319.0 | NA |
| | | | | | | | | | | | | NA |
| M | 6 | PFA 450 | 2 | 410 | 3.18 | 12.70 | 3.0 | 61 | 846 | 203 | 317.8 | 3.8 |
| N | | PFA 450 | 2 | 410 | 3.18 | 12.70 | 3.0 | 76 | 1057 | 198 | 316.5 | 3.8 |
| O | | PFA 450 | 2 | 410 | 3.18 | 12.70 | 3.0 | 91 | 1269 | 198 | 318.0. | 3.7 |
| Kronfel'd | C3 | PFA 340 | 16.1 | 390 | 1.03 | 3.95 | 22.0 | 140 | 800 | 153 | 309.6* | NA |
| | | | | | | | | | | | | NA |
| Vita | C2 | PFA 340 | 16.1 | 400 | 0.495 | 0.521 | 128.0 | 35 | 75 | 76 | 306.5 | NA |
| | | | | 200 | | | | | Drawn 2.2X | 155 | 307.6 | NA |

* -determined at 10° C./min

COMPARATIVE EXAMPLES

PFA fiber was prepared according to the method of U.S. Pat. No. 5,460,882 of Vita et al., except that in Vita 3000 filaments were spun from a single die and cooled by radial cooling, while in these comparative examples a single filament was spun into ambient air.

COMPARATIVE EXAMPLE 1

An attempt was made to produce drawn fiber according to the method cited by Vita in Example 1 of U.S. Pat. No. 5,460,882. Teflon® PFA 340, available from DuPont, with MFR of 16.3 g/10 min, was spun into fiber at 400° C. through a circular aperture measuring 0.495 mm diameter by 0.521 mm long. The shear rate was 64 $s^{-1}$ and take-up speed was 18 m/min, resulting in a SSF of 75. At these conditions severe draw resonance or instability in the diameter of the drawn fiber was observed.

COMPARATIVE EXAMPLE 2

The modifications of Vita's conditions as taught in this example were found to be satisfactory for producing a spun-drawn fiber in the manner of Vita. The resin of Comparative Example 1 was spun into fiber at 400° C. through a circular aperture measuring 0.495 mm diameter by 0.521

COMPARATIVE EXAMPLE 3

Fiber was made according to the teachings of Kronfel'd et al., Khim. Volokna, 2, pp. 28–30, 1986, wherein the SSF (called "jet stretch") was ca. 800, as shown in Table 5 for the item labeled "Kronfel'd".

What is claimed is:

1. A fluoropolymer fiber, comprising: a perfluorinated thermoplastic copolymer of tetrafluoroethylene having a melt flow rate of about 1 to about 30 g/130 min., the fiber exhibiting a tensile strength of at least 190 MPa at room temperature and a linear shrinkage of less than 15% at a temperature in the range of 40–60 centigrade degrees below the melting point of the copolymer, the copolymer being a copolymer of tetrafluoroethylene and at least one comonomer selected from the group consisting of perfluoro-olefins having at least three carbon atoms, perfluoro(alkyl vinyl) ethers, and mixtures thereof.

2. The fluoropolymer fiber of claim 1 wherein the perfluoro-olefin comonomer is a perfluorovinyl alkyl compound having a concentration in the copolymer in the range of about 3 to about 10 mol %.

3. The fluoropolymer fiber of claim 2 wherein the comonomer is hexafluoropropylene.

4. The fluoropolymer fiber of claim 1 wherein the comonomer is a perfluoro(alkyl vinyl) ether having a concentration in the copolymer in the range of about 0.5 to about 3 mol %.

5. The fluoropolymer fiber of claim 4 wherein the comonomer is perfluoropropylvinyl ether or perfluoroethylvinyl ether.

6. The fluoropolymer fiber of claim 5 wherein the fiber exhibits a linear density in the range of about $1\times10^{-7}$ to about $250\times10^{-7}$ kg/m and the linear shrinkage is <10%.

7. The fluoropolymer fiber of claim 6 wherein the linear density is in the range of about $1\times10^{-7}$ to about $12\times10^{-7}$ kg/m.

8. The fluoropolymer fiber of claim 1 wherein the melt flow rate is about 1 to about 6 g/10 min.

9. The fluoropolymer fiber of claim 1 wherein the fiber exhibits a melting point above 310° C.

10. The fluoropolymer fiber of claim 1 wherein the fiber exhibits a birefringence of greater than 0.037.

11. The fluoropolymer fiber of claim 1 in the form of a filament in a multi-filament yarn.

12. A fluoropolymer fiber exhibiting a tensile strength of at least 190 MPa and a linear shrinkage of less than 15% at a temperature in the range of 40–60 centigrade degrees below the melting point of the copolymer produced by the process comprising melting and extruding a perfluorinated thermoplastic copolymer of TFE and a comonomer selected from the group consisting of perfluoro-olefins having at least three carbon atoms, perfluoro(alkyl vinyl) ethers, and mixtures thereof, having a melt flow rate of about 1 to about 30 g/10 min., through an aperture to form one or more strands, directing the thus extruded strand or strands through a quench zone, accelerating the linear rate of progression of the strand or strands to at least 1000 times greater than the linear rate of extrusion thereof, and allowing the extrudate to solidify in transit between the extrusion aperture and a means for imposing said acceleration.

13. A fluoropolymer fiber exhibiting a tensile strength of at least 190 MPa and a linear shrinkage of less than 15% at a temperature in the range of 40–60 centigrade degrees below the melting point of the copolymer produced by the process comprising melting and extruding a perfluorinated thermoplastic copolymer of tetrafluoroethylene and a comonomer selected from the group consisting of perfluoro-olefins having at least three carbon atoms, perfluoro(alkyl vinyl) ethers, and mixtures thereof, having a melt flow rate of about 1 to about 6 g/10 min., through an aperture, to form one or more strands, directing the thus extruded strand or strands through a quench zone while accelerating the linear rate of progression of the strand or strands to at least 500 times greater than the linear rate of extrusion thereof, allowing the extrudate to solidify in transit between the extrusion aperture and a means for imposing said acceleration.

14. The fluoropolymer fiber of claims 12 or 13 wherein the fiber so produced has a shrinkage of <10% and a linear density of about $1\times10^{-7}$ to about $250\times10^{-7}$ kg/m.

15. The fluoropolymer fiber of claim 12 wherein the linear density of the fiber formed thereby is in the range of about $1\times10^{-7}$ to about $12\times10^{-7}$ kg/m.

16. The fluoropolymer fiber of claims 12 or 13 wherein the comonomer is a perfluoro-olefin having a concentration in the copolymer in the range of about 3 to about 10 mol %.

17. The fluoropolymer fiber of claim 16 wherein the comonomer is hexafluoropropylene.

18. The fluoropolymer fiber of claims 12 or 13 wherein the comonomer is a perfluoroalkyl vinyl ether having a concentration in the copolymer in the range of about 0.5 to about 3 mol %.

19. The fluoropolymer fiber of claim 18 wherein the perfluoroalkyl vinyl ether comonomer is perfluoropropylvinyl ether or perfluoroethylvinyl ether.

20. The fluoropolymer fiber of claim 12 wherein the melt flow rate is about 1 to about 6 g/10 min.

* * * * *

UNITED STATES PATENT AND TRADEMARK OFFICE

CERTIFICATE OF CORRECTION

PATENT NO. : 6,207,275 B1
DATED : March 27, 2001
INVENTOR(S) : Glenn William Heffner, William Cheng Uy, Martin Gerald Wagner It is certified that error appears in the above-identified patent and that said Letters Patent is hereby corrected as shown below:

Claim 1,
Line 50, delete "30 g/130 min.," and insert therefore -- 30 g/10 min., --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*